US005973245A

United States Patent [19]

Van Doren

[11] Patent Number: 5,973,245

[45] Date of Patent: Oct. 26, 1999

[54] LIGATURE FOR THE MOUTHPIECE OF A REED WIND INSTRUMENT

[75] Inventor: Monsieur Bernard Van Doren, Paris, France

[73] Assignee: Etablissements VanDoren, Paris, France

[21] Appl. No.: 08/950,155

[22] Filed: Oct. 14, 1997

[30] Foreign Application Priority Data

Oct. 16, 1996 [FR] France ..... 96 12615

[51] Int. Cl.[6] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| D. 390,249 | 2/1998 | Smith | 84/383 R |
| 2,791,929 | 5/1957 | Bonade . | |
| 3,205,753 | 9/1965 | Luyben . | |
| 3,433,113 | 3/1969 | Portnoy . | |
| 3,618,440 | 11/1971 | Ratterree . | |
| 4,210,055 | 7/1980 | Platamone, Jr. | 84/383 R |
| 4,275,636 | 6/1981 | Van Doren . | |

FOREIGN PATENT DOCUMENTS

| | | |
|---|---|---|
| 1594695 | 6/1970 | France . |

*Primary Examiner*—Jeffrey W. Donels
*Attorney, Agent, or Firm*—Palmatier, Sjoquist, Voigt & Christensen, P.A.

[57] ABSTRACT

A ligature for the mouthpiece of a reed wind instrument. The ligature is a flexible, pliable, and adjustable clamp collar which, when fitted to a mouthpiece, complements the shape of a mouthpiece and associated reed. The clamp has two circumferential bands held in spaced relation by a plurality of ties, with the bands intended to be arranged along two planes, more or less perpendicular to the longitudinal axis of the mouthpiece. The ligature has at least one, and preferably two, bars interposed between two of the longitudinal ties and arranged so that when the ligature is in use, the bars rest against a reed along their longitudinal extent.

5 Claims, 2 Drawing Sheets

LIGATURE FOR THE MOUTHPIECE OF A REED WIND INSTRUMENT

This patent application is a United States Utility Patent Application claiming priority to French Application No. 96 12615, filed Oct. 16, 1996, entitled "New Ligature for the Mouthpiece of a Reed Wind Instrument". Priority is claimed pursuant to 35 U.S.C. Sec. 119.

BACKGROUND OF THE INVENTION

This invention concerns a new ligature for the mouthpiece of a reed wind instrument, in particular for the mouthpiece of a clarinet.

It is known, that in instruments such as the clarinet or the saxophone, the reed is maintained in place on the mouthpiece of the instrument by a clamp collar, called a ligature, which fits the general form of the mouthpiece and rests on the external rounded side of the reed, so that the flat side of the clamp is in contact with the flat side of the mouthpiece.

The ligature is slit along one of its generating lines, and assembled such that the screws and the threaded pins are placed on the two parts which face each other, in order to attach them one to the other and to thus create an increasing clamping action on the reed.

A ligature of this type is described, for example, in the French patent No. 2 438 311, in the name of the Applicant.

Once assembled by the screws or other means of clamping, the ligature is generally in the form of a clamp having two bands, which are intended to be arranged perpendicular to the axis of the mouthpiece, in such a way to allow it as well as the related reed to be clamped, evenly spaced longitudinal ties connecting these two bands and arranged in a more or less parallel manner to the axis of the mouthpiece. These ties are usually not in contact with the reed, only the bands come into contact with it, crosswise to the fibers of the material it is made up of, the fibers arranged parallel to the axis of the mouthpiece.

SUMMARY

The Applicant has, however, established that it is possible to modify the vibration of the reed in order to obtain a tone of a different quality, by joining the two bands of the ligature by at least one, and preferably two bars arranged more or less parallel to the axis of the mouthpiece and which, when the ligature is in use, rests longitudinally against the reed.

Thus, the object of the invention is a ligature for the mouthpiece of a reed wind instrument, in particular for the mouthpiece of a clarinet, this ligature comprising a clamp of a flexible, pliable material, of a shape that complements that of the mouthpiece and the related reed, this clamp having two bands intended to be arranged on two planes more or less perpendicular to the axis of the mouthpiece, these bands being slit along one same generating line of the mouthpiece and joined by longitudinal ties, intended to be arranged in a more or less parallel manner to the axis of the mouthpiece, one or more means of clamping such that the screws and nuts are provided to bring the two parts closer to each other in relating to each of the bands, in order to apply the reed against the mouthpiece, and to separate them one from the other, this ligature is characterized by the fact that it has at least one, and preferably, two bars interposed between two longitudinal ties, parallel to these, this or these bars joining the two bands, to which they are rigidly attached, and arranged in such a way that when the ligature is in use, they rest longitudinally against the reed.

The fact of placing the bar or bars of the ligature longitudinally against the instrument reed appreciably modifies its vibration and consequently the tone resulting from the instrument.

This does not mean that the tone is "better" than that obtained with a ligature of the same type not comprising the bar or bars suitable to rest against the instrument reed. In fact, if certain instrumentalists and certain listeners judge this tone to be better, others will deem it to be less good, but this tone is different from that obtained with the usual ligatures and it is this new and original effect which makes up one of the distinctive characteristics of the ligature according to the invention, which also offers new possibilities of use with traditional wind instruments having a single reed.

A simple way of making the ligature according to the invention would be of relating the bar or an autonomous group comprising the bars transversally joined to each other, to their two ends, to a common type ligature having two bands joined by evenly spaced longitudinal ties. A ligature of this type is one of the preferred ways of carrying out this invention.

BRIEF DESCRIPTION OF THE DRAWINGS

The attached drawings, which are not restrictive, illustrate one such method of carrying out the invention. On these drawings.

DETAILED DESCRIPTION

Figure 1:
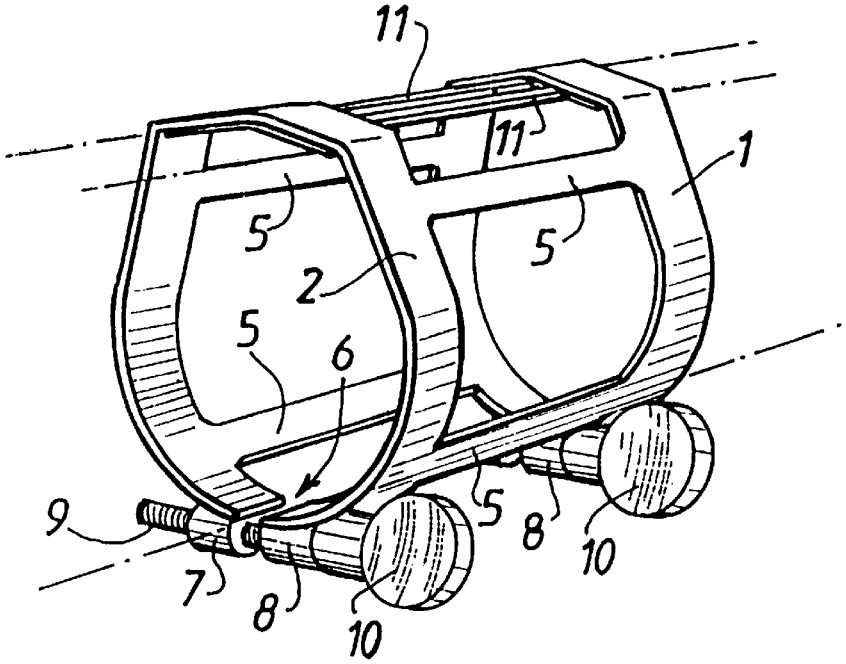
FIG. 1 is a perspective of the ligature.

The ligature represented in FIG. 1 is derived from a traditional ligature comprising a clamp of a flexible, pliable material (metal, alloy or plastic material), of a shape that complements the shape of the wind instrument mouthpiece (here, a clarinet) and of the related reed which it is intended to hold.

Figure 5:
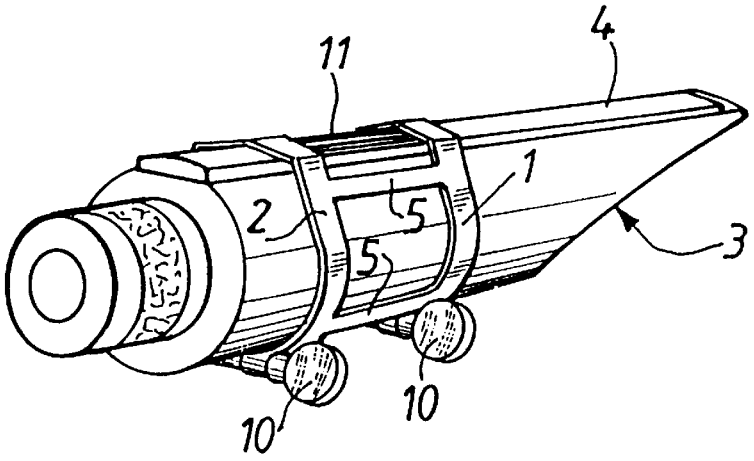
FIG. 5 is a perspective of the ligature in FIG. 1, in use on the mouthpiece of a clarinet.
Figure 4:
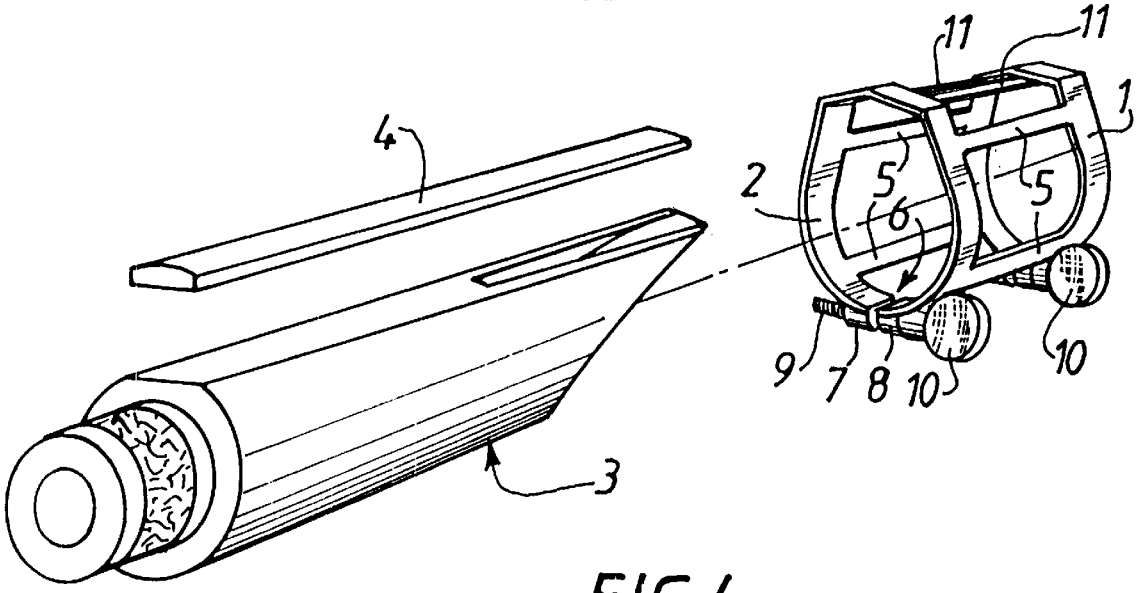
FIG. 4 is a blown up perspective illustrating the positions relative to a clarinet mouthpiece, of the related reed and of the ligature represented in FIG. 1.

This clamp has two bands 1 and 2, capable of clamping the mouthpiece 3 of the instrument and the related reed 4, these bands are intended to be arranged along two planes more or less perpendicular to the axis of the mouthpiece 3 (see FIGS. 4 and 5). The bands 1 and 2 are joined longitudinally by ties 5, evenly spaced, intended to be arranged in a more or less parallel manner to the axis of the mouthpiece of the clarinet, in contact with this mouthpiece, but not with the reed 4. The words "more or less" are used, because, in practice, the mouthpiece of a clarinet is not cylindrical, but rather of a slightly conical shape, as can be seen in FIGS. 4 and 5.

The bands 1 and 2 are slit along the same generating line of the mouthpiece of the clarinet, as can be seen on 6 in FIG. 1 or in FIG. 4. The two edges of the slits, such as 6, are fitted with nuts 7 and 8, comprise holes with a reverse thread, into which the stem 9 is screwed, having two threads, along complementary paths, which also are reversed, longitudinally shifted forward. By turning the head of the screw 10 one way or the other, it is thus possible to bring closer or to move apart one or the other opposite edges of the slits, such as 6, to clamp or unclamp the ligature onto the mouthpiece 3, to attach or detach the reed 4 of this mouthpiece.

It can be seen that in this configuration, represented in FIG. 2, the unit, made up of the slit bands 1 and 2 and the ties 4, is made according to a known method by a simple and appropriate cut in the form of a grid of a flat band and subsequently conforming the flat piece which results from the cutting.

According to the invention, the ligature has two bars 11, interposed between two adjoining ties 5, parallel to these, which connect the bands 1 and 2 and which are intended to be applied longitudinally against the reed 4, in the direction of the fibers of the wood, to modify the vibrations of this reed and the sound emitted by the instrument.

Figure 2:
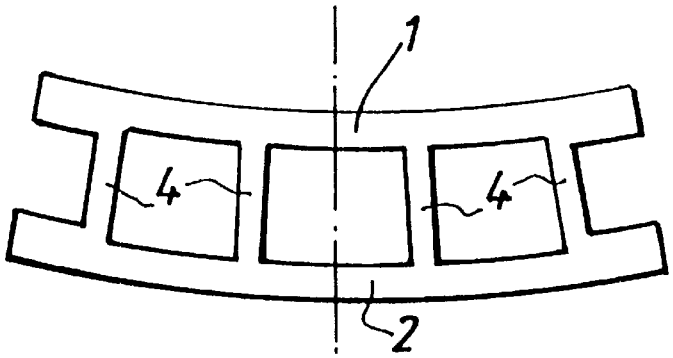
FIGS. 2 and 3 illustrate two means of departure, the implementation and the assembly from which results the ligature represented in FIG. 1.
Figure 3:
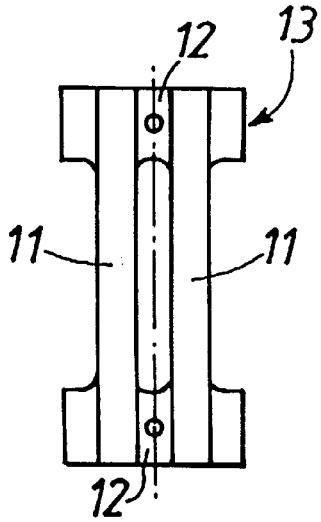

In the present case (see FIG. 3), the bars 11 are joined crosswise, at their ends, by a junction 12 to form an autonomous unit 13, which is added to the usual ligature arising from the piece represented in FIG. 2 and is attached by soldering or punching.

Thus, the invention technically provides a particularly simple ligature which offers new tonal expression to wind instruments having a single reed, in particular, clarinets.

I claim:

1. A ligature for releasably retaining a reed onto a mouthpiece of a wind instrument, the ligature comprising: a first flexible, circumferential band having opposing ends and a second flexible circumferential band having opposing ends, the first and second bands connected to each other by a plurality of longitudinal ties, the opposing ends of the respective first and second bands adjustably movable relative to each other to thereby vary the amount of clamping force exertable by the first and second bands; and a first longitudinal bar, the first bar interposed between two longitudinal ties in a parallel relation, the first bar configured to contact a reed along its longitudinal extent, thereby changing the tonal characteristics produced by the wind instrument.

2. The ligature as in claim 1, wherein the first and second flexible circumferential bands are arcuately shaped.

3. The ligature as in claim 1, further comprising clamping means for adjustably moving the opposing ends of the first and second bands toward and away from each other.

4. The ligature as in claim 3, wherein the clamping means are in diametric relation to the first longitudinal bar.

5. The ligature as in claim 3, further comprising a second longitudinal bar, the second bar in parallel relation to the first bar, the first and second bars configured to contact a reed along its longitudinal extent, thereby changing the tonal characteristics produced by the wind instrument.

* * * * *